US006768877B2

(12) United States Patent
Alegria et al.

(10) Patent No.: US 6,768,877 B2
(45) Date of Patent: Jul. 27, 2004

(54) SYSTEMS AND METHODS FOR LIMITING ACCESS TO IMAGING DEVICE CONSUMABLE COMPONENTS

(75) Inventors: Andrew Alegria, Nampa, ID (US); Brett Smith, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/307,070

(22) Filed: Nov. 27, 2002

(65) Prior Publication Data

US 2004/0101321 A1 May 27, 2004

(51) Int. Cl.[7] ..... G03G 15/00; G03G 15/08

(52) U.S. Cl. ..... 399/9; 399/24; 399/80; 399/227

(58) Field of Search ..... 399/12, 13, 24–27, 399/31, 34, 35, 72, 79, 80, 227, 9, 81

(56) References Cited

U.S. PATENT DOCUMENTS 5,959,530 A * 9/1999 Lupien et al. ..... 399/80 X
6,091,912 A * 7/2000 Kitajima et al. ..... 399/13
6,122,469 A * 9/2000 Miura et al. ..... 399/227
6,421,582 B1 * 7/2002 Wada ..... 399/80 X
6,560,416 B2 * 5/2003 Fischer ..... 399/27

* cited by examiner

*Primary Examiner*—William J. Royer

(57) ABSTRACT

Systems and methods for limiting access to imaging device consumable components are disclosed. In one embodiment, a system and a method pertain to receiving authorization information from a user, determining whether the authorization information is valid, and preventing specific access to a consumable component if the authorization is not valid.

30 Claims, 6 Drawing Sheets

SYSTEMS AND METHODS FOR LIMITING ACCESS TO IMAGING DEVICE CONSUMABLE COMPONENTS

BACKGROUND OF THE INVENTION

Imaging devices such as laser or inkjet printers, photocopy machines, large format plotters, facsimile machines, and the like use consumable components that must be periodically replaced. For instance, electrophotographic imaging devices typically comprise removable cartridges that contain toner used to develop images (e.g., textual, graphical, or photographic images) on print media such as paper.

In environments in which such imaging devices are shared, for instance in an office environment, it is often desirable to exercise control over who may and may not access device consumable components. One reason for this is to prevent premature replacement of the consumable components and therefore ensure greater utilization of such products. Another reason for exercising this control is to prevent damage to the imaging device by someone who is attempting to replace a consumable component but who, due to his or her inexperience with this task, could possibly damage the imaging device. In some cases, control over consumable component access is desirable to prevent theft of imaging device consumable components.

In recognition of the value of extending access to imaging device consumable components to only select persons (e.g., authorized system administrators), various access limitation solutions have been proposed. In one such solution, the exterior door to the imaging device may simply be locked, for example with a lock and key, so that only persons with a key may access the consumable components. In a variation on this solution, systems have been proposed in which the exterior door to the imaging device is normally locked and can only be unlocked when an appropriate code (e.g., password) is entered, for example, using the device control panel.

Although the aforementioned solutions do limit access to imaging device consumable components, they further prevent persons from accessing the internal mechanisms of the imaging device for legitimate purposes. For example, if a paper jam occurs during a print job and an exterior door of the imaging device is locked, the user that sent the print job to the imaging device may not be able to clear the jam unless that user also has the means (e.g., key or code) necessary to open the exterior door in that the door may be the only access point to the paper path. Clearly, this can create problems in situations in which those persons with the means to access the interior of the imaging device are not in the vicinity or are otherwise unavailable.

From the above, it can be appreciated that it would be desirable to have a system and method with which access to consumable components can be limited without generally denying access to the interior of an imaging device.

SUMMARY OF THE DISCLOSURE

Systems and methods for limiting access to imaging device consumable components are disclosed. In one embodiment, a system and a method pertain to receiving authorization information from a user, determining whether the authorization information is valid, and preventing specific access to a consumable component if the authorization is not valid.

BRIEF DESCRIPTION OF THE DRAWINGS

The disclosed systems and methods can be better understood with reference to the following drawings. The components in the drawings are not necessarily to scale.

DETAILED DESCRIPTION

As noted above, it is desired to limit access to imaging device consumable components without denying access to other parts of the imaging device so that routine maintenance, such as jam clearing, may be performed by substantially all device users. As is disclosed in the following, access to consumable components can be limited by providing a software or firmware-based locking mechanism that specifically prevents unauthorized users from accessing the imaging device consumable components. In some embodiments, access to these consumable components is permitted only if a correct code, such as a username and/or password, is provided, for example using the imaging device control panel. The nature of the locking mechanism depends upon the particular configuration of the imaging device. In one embodiment, the locking mechanism comprises a mechanism that locks a carousel in which toner cartridges are housed. In another embodiment, the locking mechanism comprises a mechanism that locks an interior access door that leads to one or more toner cartridges.

Figure 1:
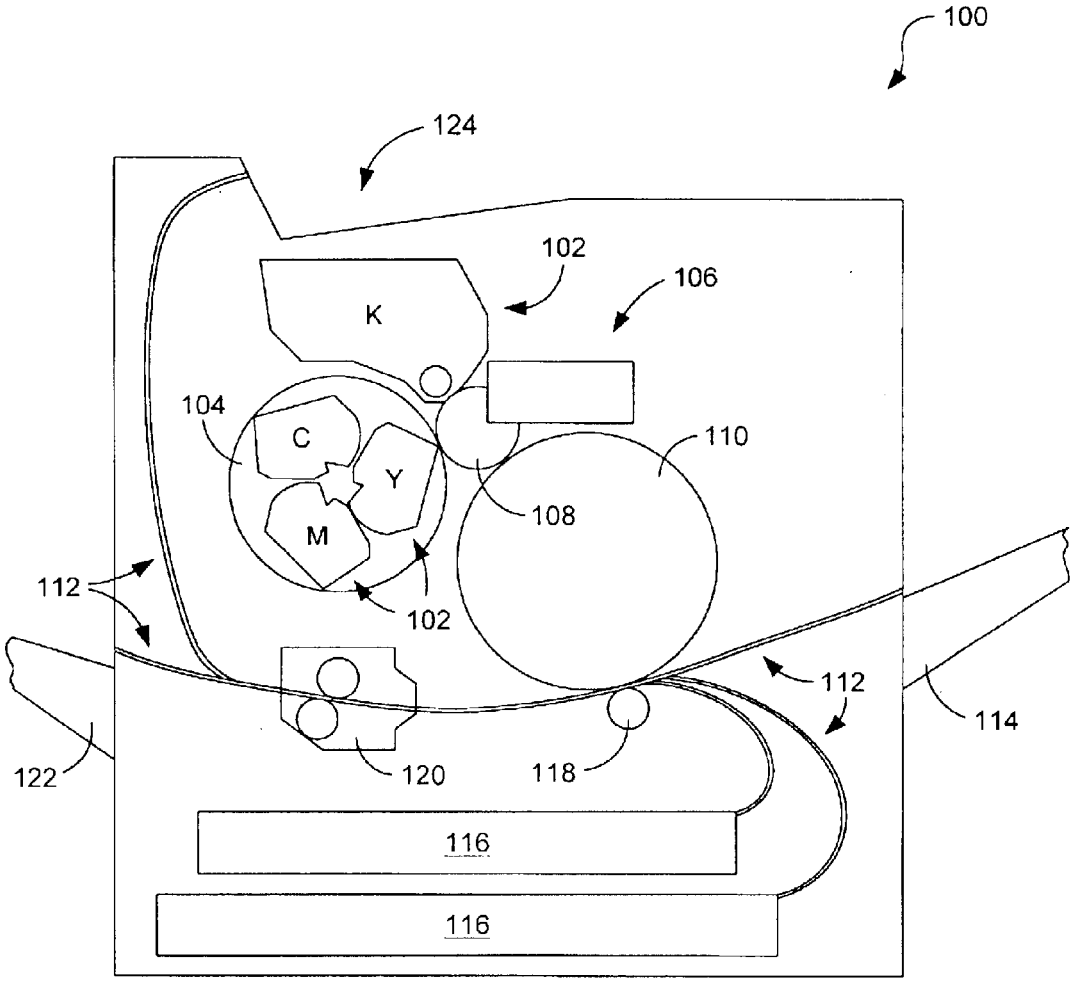
FIG. 1 is a schematic view of an imaging device in which access to consumable components can be limited.

Reference is now made to the drawings, in which like numerals indicate corresponding parts throughout the several views. Although various specific embodiments are illustrated in these drawings and described herein, these embodiments are merely illustrative of the disclosed systems and methods. With reference to FIG. 1, shown is an imaging device 100 that is configured to generate hardcopy documents. As indicated in the figure, the imaging device 100 can comprise an electrophotographic (EP) printer. Although a printer is specifically illustrated in FIG. 1, the imaging device 100 can comprise another type of imaging device such as an inkjet printer, photocopier, large format plotter, facsimile device, scanner, or multi-function peripheral (MFP). Therefore, more generally, the imaging device 100 comprises substantially any imaging device that includes a consumable component that may periodically be replaced.

The imaging device 100 comprises one or more consumable components 102 that, for example, comprise dry or liquid toner cartridges. In the embodiment shown in FIG. 1, the imaging device 100 is a multicolor imaging device and therefore comprises separate toner cartridges for each of the colors cyan (C), yellow (Y), magenta (M), and black (K). As is further indicated in FIG. 1, the cyan, yellow, and magenta toner cartridges are housed in a carousel 104 that is used to rotate the toner cartridges into position relative to a process module 106.

The process module 106 is used to develop toner images that are to be transferred to print media, such as sheets of paper. As indicated in the figure, the process module 106 includes a photoconductive member 108 that, for example, comprises a photoconductive drum. The process module 106 includes various other components not indicated in the schematic view of FIG. 1. By way of example, these other components may comprise a charge roller that applies a charge to the photoconductive member 108 and a laser scanner that discharges portions of the charge on the photoconductive member to generate a latent image thereon.

Once a latent image has been formed on the photoconductive member 108, the image is developed by applying toner to the photoconductive member from the toner cartridges 102, typically using a developer roller (not shown). After the developed image has been formed on the photoconductive member 108, the image is transferred to an intermediate transfer member 110, which may comprise an electrically conductive drum or belt. Further indicated in FIG. 1 is a variety of media paths 112 that deliver print media (e.g., paper) within the imaging device 100. In particular, the media paths 112 deliver print media from an input tray 114 and from media trays 116 past the intermediate transfer member 110. Through application of an electrical charge provided by a transfer roller 118, the developed image that was transferred to the intermediate transfer member 110 is then transferred to the print media.

In the case of a dry toner imaging device, the print media is next delivered along a media path 112 to a fuser 120 that fuses the dry toner to the print media. Alternatively, where the imaging device 100 uses liquid toner (e.g., ink), the print media is next delivered to an appropriate drying device (not shown). Finally, the now printed print media may be output from the imaging device 100 to a side output tray 122 or to a top output tray 124.

Figure 2:
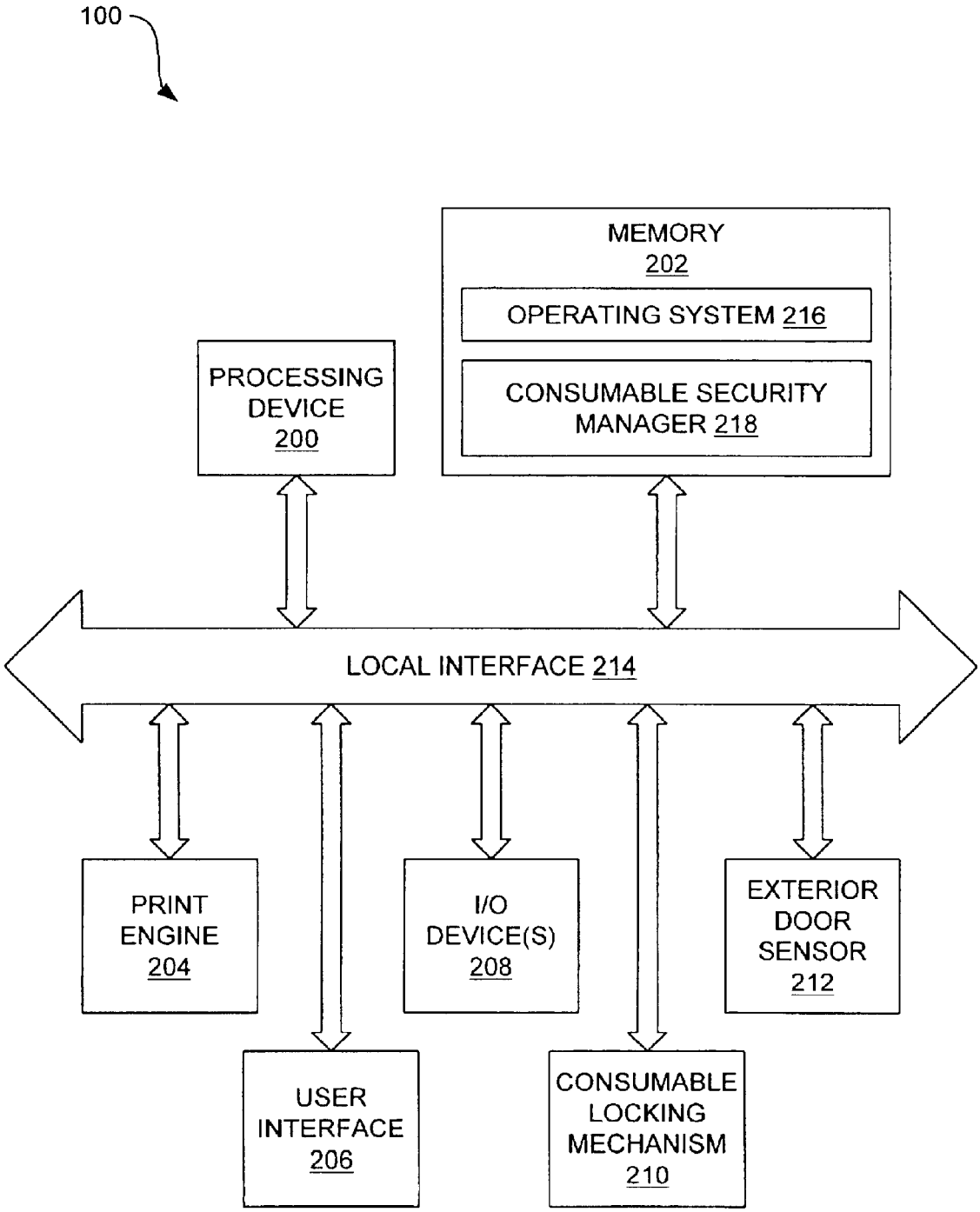
FIG. 2 is a block diagram of an example configuration of the imaging device of FIG. 1.

FIG. 2 is a block diagram of an example configuration for the imaging device 100 shown in FIG. 1. As indicated in FIG. 2, the imaging device 100 can comprise, for instance, a processing device 200, memory 202, a print engine 204, a user interface 206, one or more input/output (I/O) devices 208, a consumable locking mechanism 210, and an exterior door sensor 212. Each of these components is connected to a local interface 214 that, by way of example, comprises one or more internal buses. The processing device 200 is adapted to execute commands stored in memory 202 and can comprise a general-purpose processor, a microprocessor, one or more application-specific integrated circuits (ASICs), a plurality of suitably configured digital logic gates, and other well known electrical configurations comprised of discrete elements both individually and in various combinations to coordinate the overall operation of the imaging device 100. The memory 202 can include any one of a combination of volatile memory elements (e.g., random access memory (RAM)) and nonvolatile memory elements (e.g., Flash memory, magnetic random access memory (MRAM)).

Various components of the print engine 204 have been described above with reference to FIG. 1. The print engine 204 may, however, include other components such as, for example, various conveying mechanisms for delivering print media along the paths 112. The user interface 206 comprises the interface tools with which the imaging device settings can be changed and through which the user can communicate commands to the device 100. The user interface 206 may comprise a control panel that includes various buttons or keys with which information may be entered and a display with which various information can be communicated to the user. In some embodiments, the display may be touch-sensitive such that the display can also be used to change settings and enter commands. As is discussed in greater detail below, the control panel may further be used to enter authorization information, such as a username and/or a password, used to gain access to consumable components of the imaging device 100.

The one or more I/O devices 208 comprise components used to facilitate connection of the imaging device 100 to another device. These I/O devices 208 can, for instance, comprise one or more serial, parallel, small system interface (SCSI), universal serial bus (USB), or IEEE 1294 (e.g., Firewire™) connection devices.

The consumable locking mechanism 210 is configured to limit access to consumable components of the imaging device 100. The nature of the locking mechanism 210 depends upon the particular configuration of the imaging device 100 and the consumable components that are to be secured. Examples of such locking mechanisms 210 are described below. When provided, the exterior door sensor 212 is used to detect and communicate when the exterior door of the imaging device 100 is open so the locking mechanism 210 can be controlled accordingly.

The memory 202 includes various programs (in software and/or firmware) including an operating system 216 and a consumable security manager 218. The operating system 216 contains the various commands used to control the general operation of the imaging device 100. The consumable security manager 218 comprises the various commands used to control actuation of the consumable locking mechanism 210 and, thereby, control access to the consumable components. Moreover, the consumable security manager 218 comprises the various commands used to control the authorization process used to ensure that the locking mechanism 210 is not locked when access to the consumable components is desired. Operation of the consumable security manager 218 is described below.

Various programs have been identified above. These programs can be stored on any computer-readable medium for use by or in connection with any computer-related system or method. In the context of this disclosure, a computer-readable medium is an electronic, magnetic, optical, or other physical device or means that can contain or store code (e.g., in the form of a computer program) for use by or in connection with a computer-related system or method. The code can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. The term "computer-readable medium" can be any means that can store, communicate, propagate, or transport the code for use by or in connection with the instruction execution system, apparatus, or device.

The computer-readable medium can be, for example but not limited to, an electronic, magnetic, optical, electromagnetic, infrared, or semiconductor system, apparatus, device, or propagation medium. More specific examples (a nonexhaustive list) of the computer-readable media include an electrical connection having one or more wires, a portable computer diskette, a random access memory (RAM), a read-only memory (ROM), an erasable programmable read-only memory (EPROM, EEPROM, or Flash memory), an optical fiber, and a portable compact disc read-only memory (CDROM). Note that the computer-readable medium can even be paper or another suitable medium upon which a program is printed, as the program can be electronically captured, via for instance optical scanning of the paper or other medium, then compiled, interpreted or otherwise processed in a suitable manner if necessary, and then stored in a computer memory.

Example systems having been described above, examples of operation of the systems will now be discussed. In the discussions that follow, flow diagrams are provided. Any process steps or blocks in these flow diagrams may represent modules, segments, or portions of code that include one or more executable instructions for implementing specific logical functions or steps in the process. Although particular example steps are described, alternative implementations are feasible. Moreover, steps may be executed out of order from that shown or discussed, including substantially concurrently or in reverse order, depending on the functionality involved.

As noted above, it is desirable in some situations to be able to secure imaging device consumable components, such as toner cartridges, while still permitting access to other imaging device components. Such functionality can be obtained by using a software or firmware-based security system in which the consumable components are locked to all but those authorized to access them. An example of the imaging device 100 operating in this capacity is provided in FIG. 3. In this example, it is assumed that a user is attempting to change one or more consumable components. Although this example is provided, the methodology described also pertains to any situation in which access to a consumable component is desired. For example, the user may instead merely wish to inspect one or more of the consumable components.

Figure 3:
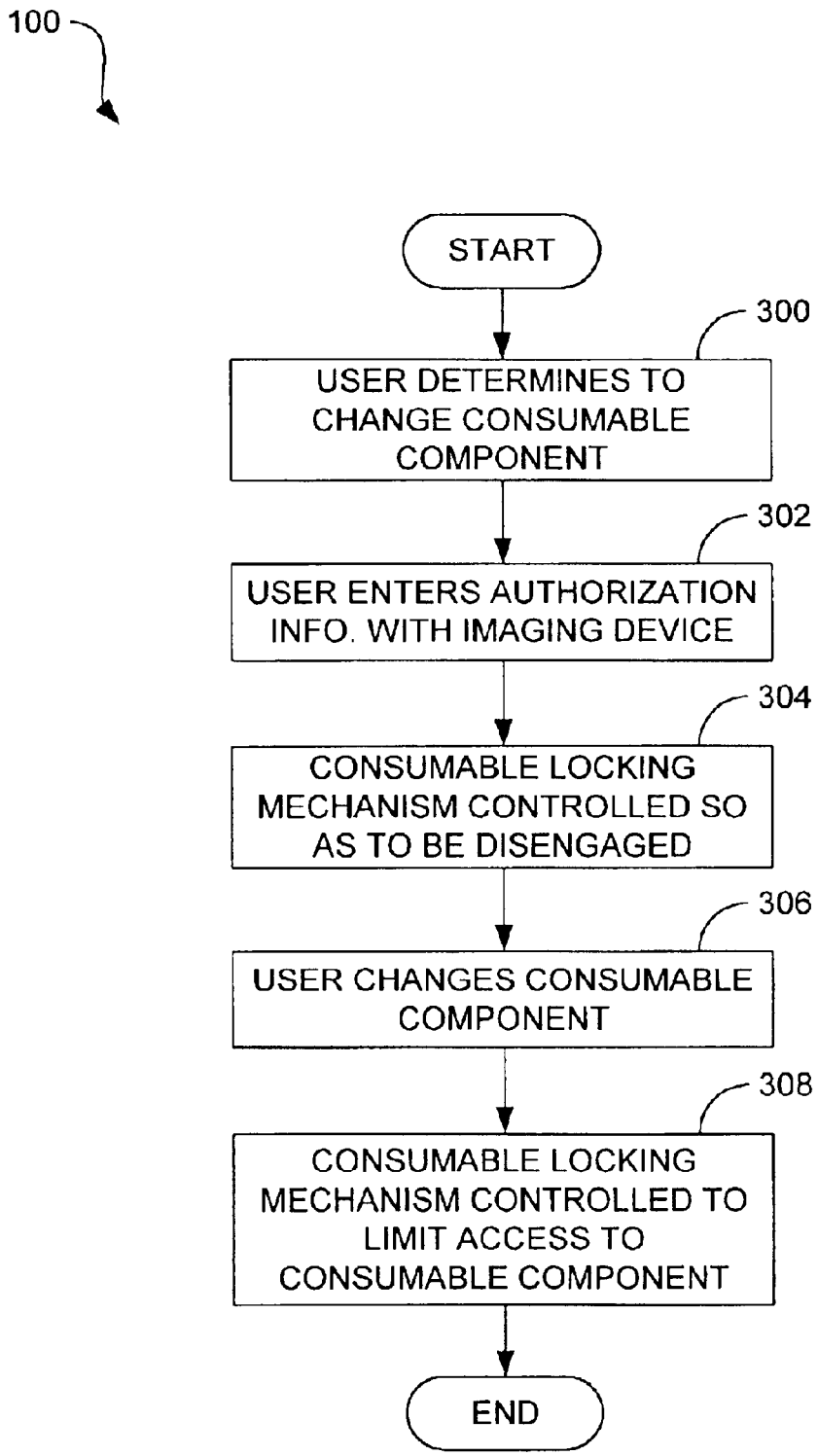
FIG. 3 is a flow diagram that illustrates an example of operation of the imaging device of FIG. 1 in a manner in which access to consumable components of the device is limited to authorized persons.

Beginning with block 300 of FIG. 3, a user determines to change a consumable component. It is assumed in this example that the user is a person authorized to access the consumable components in this manner. Accordingly, the user may comprise, for instance, a system administrator such as an information technology (IT) professional. The consumable component can comprise any replaceable component contained within the imaging device. By way of example, the component may be a toner cartridge of the device. Another example component is a replaceable fuser of the imaging device.

Next, with reference to block 302, the user enters authorization information with the imaging device. The authorization information may comprise one or more of a username and a password that the user enters using the user interface of the imaging device. More generally, however, the authorization information comprises any information communicated to the imaging device that can be used by the device to determine whether the user is authorized to access the consumable component at issue. In some embodiments, the authorization information may be contained within a storage device read by the imaging device. For instance, the authorization information may be read from a data card using an appropriate card reader of the imaging device.

Assuming a valid authorization information has been entered, the consumable locking mechanism that limits access to the consumable component is controlled so as to be disengaged when the user will attempt to access the consumable component, as indicated in block 304. In the consumable component changing scenario of this embodiment, the user next changes the consumable component by removing it and installing a new consumable component, as indicated in block 306. This may, for instance, comprise removing and discarding an empty toner cartridge and replacing it with a full toner cartridge. Once the consumable component has been changed, the locking mechanism is again controlled so as to limit access to the consumable component, locking mechanism is again locked, as indicated in block 308.

Figure 4:
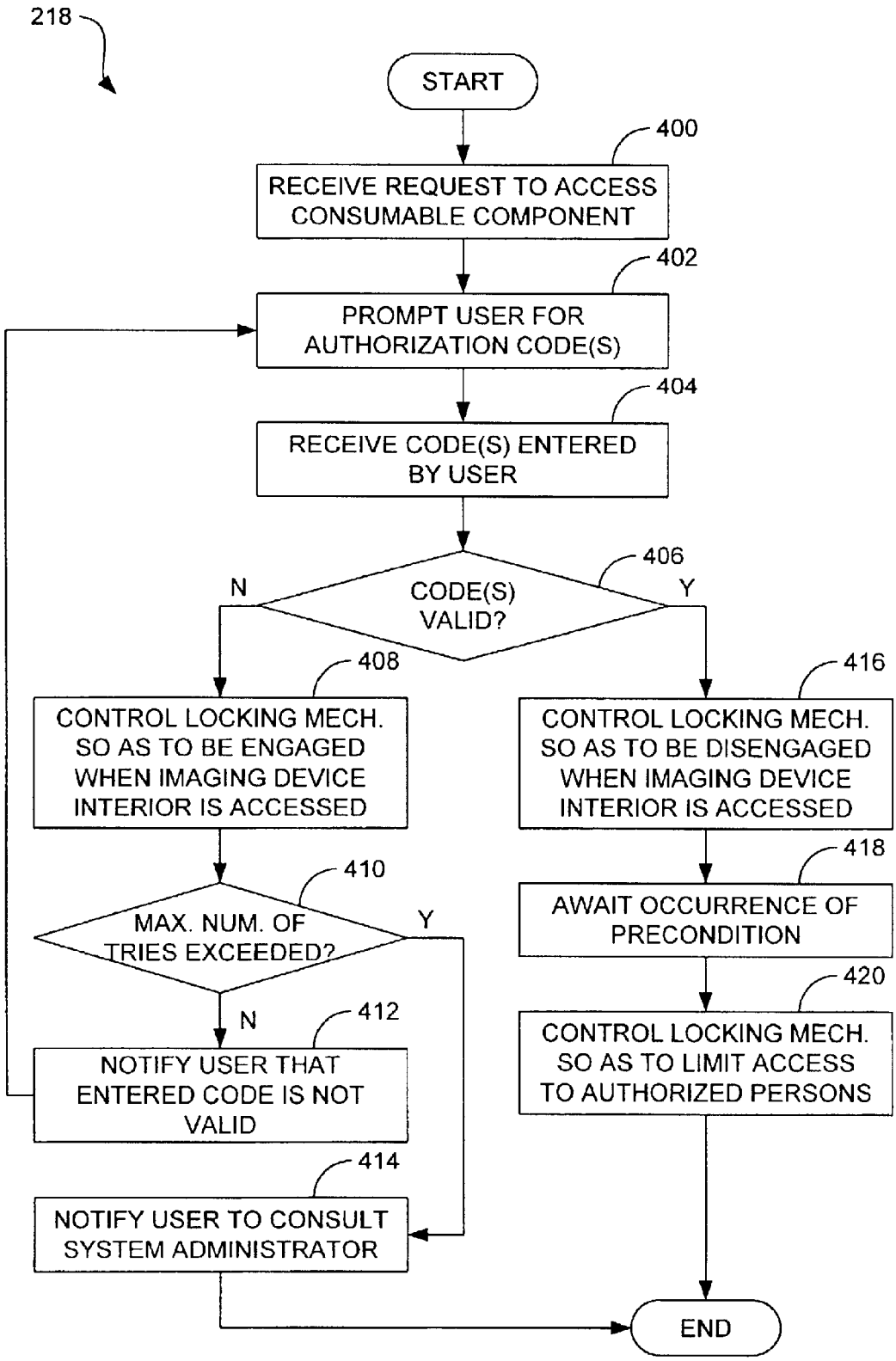
FIG. 4 is a flow diagram that illustrates an example of operation of a consumable security manager shown in FIG. 2 in limiting access to consumable components of an imaging device to authorized persons.

FIG. 4 illustrates an example of operation of the consumable security manager 218 shown in FIG. 2. Beginning with block 400, the manager 218 receives a request to access a consumable component. By way of example, this request can be registered with the imaging device by using the device control panel and navigating various menus presented to the user in a display of the control panel. For instance, the "request" may simply comprise navigating to a consumable component access menu. Once the request has been received, the user is prompted to enter one or more authorization codes, as indicated in block 402. By way of example, the user may be prompted with a textual message requesting the authorization codes to be provided. Alternatively or in addition, one or more character fields can be presented in the display in which to enter the authorization code or codes. As noted above, an authorization code can comprise substantially any information that can be used to determine whether the user is authorized to access the consumable component. For instance, this information may comprise a username and/or password. This information may be entered manually by the user via buttons or keys provided on the control panel and/or the display, or may be automatically read by the imaging device, for instance when an appropriate data card is swiped through a card reader by the user. The authorization information may, alternatively, be received by the imaging device indirectly from another device. For instance, the authorization information may be entered at a user's PC and transmitted to the imaging device via a direct (wired or wireless) connection or network connection, or the information may be entered in a network page hosted by an embedded network server of the imaging device where the imaging device is so equipped.

In any case, once the authorization code or codes is/are received, as indicated in block 404, the consumable security manager 218 determines whether the provided information is valid, as indicated in decision block 406. If not, the locking mechanism is controlled by the security manager 218 such that the mechanism will be engaged (i.e., locked) when the imaging device interior is accessed, as indicated in block 408. Under such control, the locking mechanism will be engaged when, for example, the exterior door of the device is opened, as indicated to the security manager 218 by the exterior door sensor 212. Although not identified in FIG. 4, the authorization code(s) entered by the user may, optionally, be stored in an imaging device event log within device memory so as to provide a record as to which users have attempted (successfully or unsuccessfully) to access imaging device consumable components.

Figure 5:
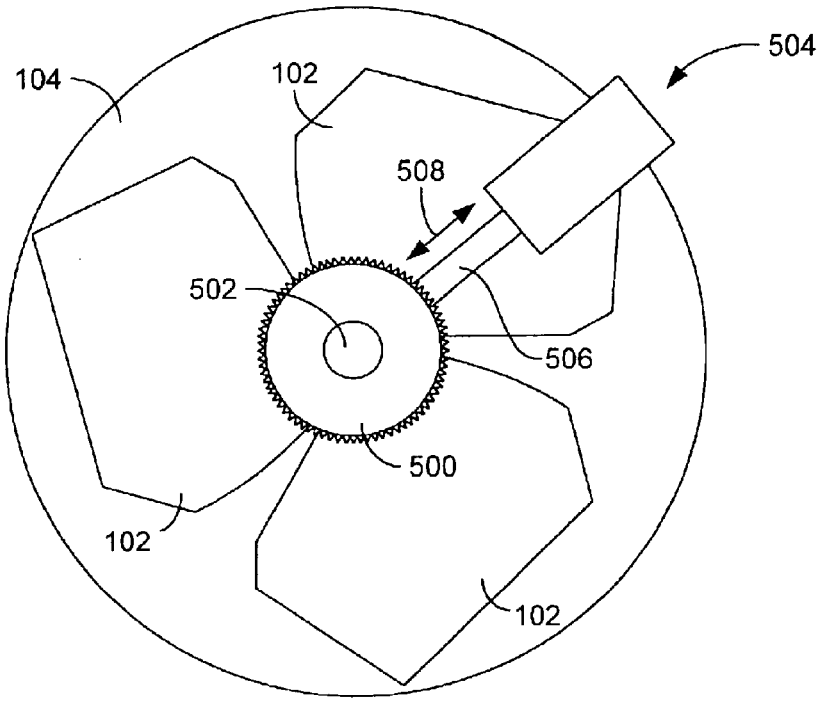
FIG. 5 is a schematic view of an example carousel locking arrangement that may be used to limit access to imaging device toner cartridges.
Figure 6:
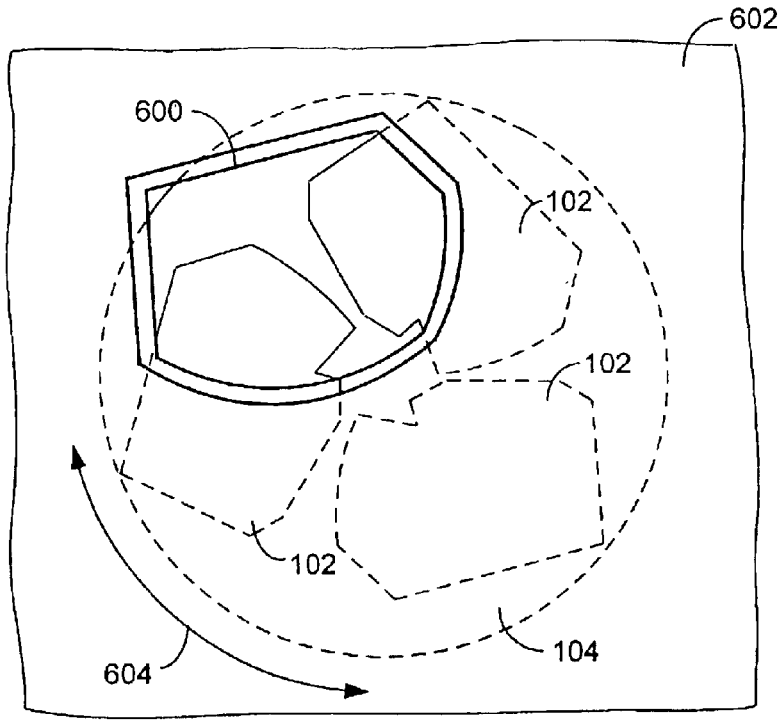
FIG. 6 is a schematic view of an example carousel displacement arrangement that may be used to limit access to imaging device toner cartridges.
Figure 7:
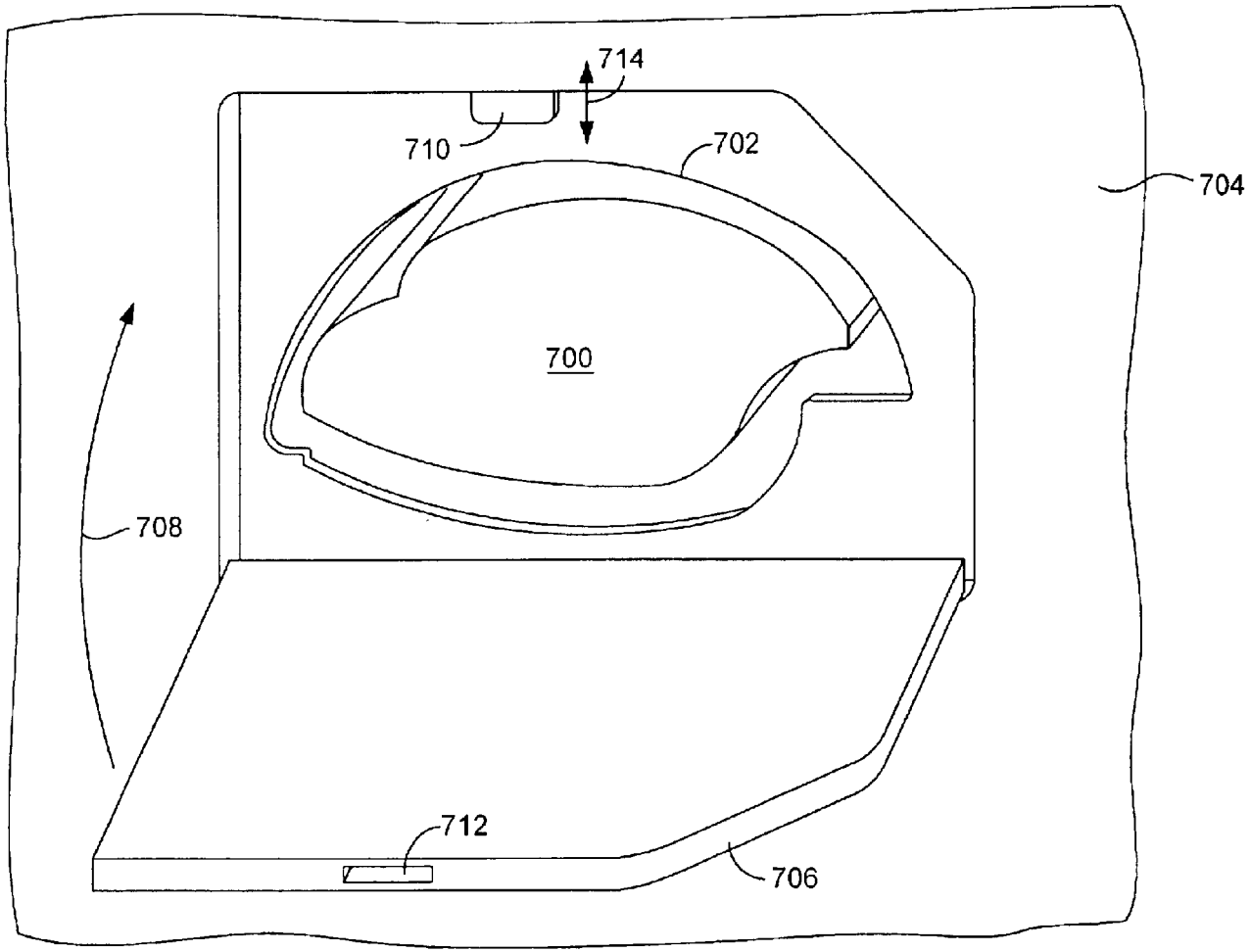
FIG. 7 is a schematic view of a further example locking arrangement that may be used to limit access to imaging device toner cartridges.

Example locking mechanisms are illustrated in FIGS. 5–7. Beginning with FIG. 5, schematically illustrated is a rear end of the toner cartridge carousel 104 shown in FIG. 1 as well as a drive gear 500 that is used to rotate the carousel 104 and, thereby, rotate the various toner cartridges 102 into position relative to the photoconductive member 108. The drive gear 500 is mounted on a shaft 502 of the carousel 104. Also depicted is a locking mechanism 504 that comprises a gear locking member 506 that may be engaged or disengaged through displacement in the directions of arrow 508. When the gear locking member 506 is engaged as indicated in FIG. 5, for example when the exterior door of the imaging device is opened, rotation of the carousel 104 is inhibited. Inhibiting rotation in this manner prevents one or more toner cartridges 102 from being removed from an opening 600 of the imaging device interior panel 602, shown in FIG. 6, that is sized to only permit passage of a single toner cartridge at a time.

Optionally, the toner cartridges 102 and the opening 600 are arranged relative to one another such that, as indicated in FIG. 6, no cartridges align with the opening, except when valid authorization information is provided. In such a case, persons without authorization will not be able to remove any of the toner cartridges 102 and further will not be able to rotate the carousel 104 so that a cartridge may be removed through the opening 600. Even where such an arrangement is not used, however, no more than one cartridge 102 will be removable by an unauthorized person in that the carousel will not be rotatable due to engagement of the locking mechanism 504.

FIG. 7 illustrates an alternative locking mechanism. Schematically illustrated in this figure is a toner cartridge 700 that is removable from and insertable into the imaging device through an opening 702 that is provided in an interior panel 704 of the imaging device. In this embodiment, a toner cartridge access door 706 is provided (shown in the open position) that can be closed, in the manner indicated by arrow 708, against the interior panel 704 so as to cover the opening 702. When in the closed position, a locking member 710 of the locking mechanism 210 can engage the access door 706, for instance by entering a slot 712 provided in the access door 706, to lock the access door 706. In particular, the locking member 710 can be actuated under the control of the security manager 218 to be extended or retracted in the directions indicated by arrow 714. By way of example, the locking member 710 can normally be situated in the extended position such that access door 706 is normally locked. Although a mechanically actuable lock is illustrated in FIG. 7, an electromagnetic lock could alternatively be used.

With reference back to FIG. 4, if the required code or codes has or have not been provided, flow continues from block 408 to decision block 410 at which it is determined whether a maximum number of tries has been exceeded. In other words, it is determined whether the number of attempts at providing the correct authorization code(s) has been exceeded. By way of example, two or three attempts may be set to be the maximum number of tries. If the maximum number of tries has not been exceeded, the user is notified, for instance using the control panel display, that one or more of the entered codes is not valid, as indicated in block 412. At this point, flow returns to block 402 and the user is again prompted to provide the user code(s), and flow continues in the manner described above. With reference back to decision block 410, if the maximum number of tries has been exceeded, flow continues to block 414 at which the user is notified to consult the system administrator, and flow for the session is terminated. In such a case, the user is prevented from accessing the consumable component.

Referring again to decision block 406, if the entered code or codes is/are valid, thereby indicating that the user is authorized to access the consumable component, flow continues to block 416 and the locking mechanism is controlled such that it will be disengaged when the interior of the imaging device is accessed. Where the locking mechanism is configured as indicated in FIGS. 5 and 6, this means that the locking member 506 will not be engaged with the drive gear 500 when the exterior door of the imaging device is opened. Therefore, the carousel 104 can either be manually rotated by the user to align the toner cartridge 102 to be removed with the opening 600, or the carousel 104 can be automatically indexed so as to provide such alignment. In situations in which the toner cartridges 102 are normally not aligned with the opening 600, automatic rotation of the carousel 104 may be required, as indicated by arrow 604. Where the locking mechanism is configured as indicated in FIG. 7, the locking member 710 is retracted such that the access door 706 can be opened by the user and the toner cartridge 700 removed.

Next, with reference to block 418 of FIG. 4, the security manager 218 can await the occurrence of a precondition to return control of the locking mechanism to the state in which it was prior to entry of the valid authorization code(s). By way of example, this precondition can be closing of the exterior door of the imaging device as signaled by the exterior door sensor 212. Other preconditions may include expiration of a given time period or entry by the user of an appropriate command indicating to the security manager 218 to limit access to the consumable component. In any case, occurrence of the precondition results in controlling the locking mechanism so as to limit access to authorized persons, as indicated in block 420. In the locking mechanism embodiment of FIGS. 5 and 6, this translates into controlling the locking mechanism so as to engage the drive gear 500 when the exterior door is opened without the correct authorization code(s) first being entered. In the locking mechanism embodiment of FIG. 7, this translates into again engaging the locking mechanism such that the access door 706 is locked.

Operating in the manner described above, access to consumable components, such as toner cartridges, can be limited without preventing users from performing routine maintenance such as jam clearing in situations in which there is one access point that leads to both the consumable components and other device elements such as paper paths. Accordingly, specific access to a consumable component can be limited without limiting access to the imaging device interior as a whole.

What is claimed is:

1. A method for limiting access to consumable components in an imaging device, comprising:

receiving authorization information from a user;

determining whether the authorization information is valid; and preventing specific access to a consumable component if the authorization information is not valid.

2. The method of claim 1, wherein the step of receiving authorization information comprises receiving an authorization code.

3. The method of claim 2, wherein the step of receiving authorization information comprises receiving an authorization code entered by the user via a control panel of the imaging device.

4. The method of claim 1, wherein the step of preventing specific access comprises engaging a locking mechanism.

5. The method of claim 4, wherein the step of engaging a locking mechanism comprises locking a carousel in which a consumable component is housed such that the carousel cannot be rotated.

6. The method of claim 1, wherein the step of preventing specific access comprises not disengaging a locking mechanism.

7. The method of claim 6, wherein the step of not disengaging a locking mechanism comprises not disengaging a locking mechanism that locks an access door that leads to the consumable component.

8. The method of claim 1, further comprising enabling access to a consumable component if the authorization information is valid.

9. The method of claim 8, wherein the step of enabling access comprises controlling a locking mechanism such that the locking mechanism will not disengage when an interior of the imaging device is accessed.

10. The method of claim 8, wherein the step of enabling access comprises unlocking an access door that leads to the consumable component.

11. A system for limiting access to consumable components in an imaging device, comprising:

a locking mechanism that is configured to selectively prevent access specifically to a consumable component; and a consumable security manager configured to control the locking mechanism in response to authorization information provided by a user who wishes to access the consumable component.

12. The system of claim 11, wherein the locking mechanism is configured to prevent rotation of a carousel in which at least one consumable component is disposed.

13. The system of claim 11, wherein the locking mechanism is configured to lock an access door that leads to the consumable component.

14. The system of claim 11, further comprising an exterior door sensor that is configured to detect and signal when an exterior door of the imaging device is open.

15. The system of claim 14, wherein the consumable security manager locks the locking mechanism when invalid authorization information is received and the exterior door is opened.

16. A consumable security manager stored on a computer-readable medium, comprising:

logic configured to prompt a user for authorization information;

logic configured to receive entered authorization information;

logic configured to determine whether the entered authorization information is valid; and logic configured to prevent access specifically to a consumable component if the authorization information is invalid.

17. The manager of claim 16, wherein the logic configured to prevent access comprises logic configured to engage a locking mechanism.

18. The manager of claim 17, wherein the logic configured to prevent access comprises logic configured to engage a locking mechanism that prevents rotation of a carousel in which a consumable component is housed.

19. The manager of claim 16, wherein the logic configured to prevent access comprises logic configured to not disengage a locking mechanism.

20. The manager of claim 19, wherein the logic configured to prevent access comprises logic configured to not disengage an access door locking mechanism that locks an access door that leads to the consumable component.

21. An imaging device, comprising:

a print engine;

a removable consumable component;

a consumable component locking mechanism;

a processing device; and memory containing a consumable security manager configured to determine whether authorization information provided by a user is valid and, if not, control the locking mechanism such that the consumable component cannot be removed when an interior of the imaging device is accessed.

22. The imaging device of claim 21, further comprising an exterior door that provides access to the imaging device interior and an exterior door sensor that is configured to detect when the exterior door is open.

23. The imaging device of claim 22, wherein the consumable security manager is configured to engage the locking mechanism when invalid authorization information is provided and the exterior door is opened.

24. The imaging device of claim 23, further comprising a carousel in which the consumable component is housed, wherein engaging the locking mechanism comprises engaging the carousel such that it cannot rotate.

25. The imaging device of claim 21, wherein the consumable security manager is configured to release the locking mechanism when valid authorization information is provided.

26. The imaging device of claim 25, further comprising an access door that leads to the consumable component, wherein releasing the locking mechanism releases the access door.

27. A locking mechanism used to limit access to a consumable component in an imaging device, comprising:

a locking member that is configured to engage a drive gear of a carousel that houses the consumable component when valid authorization information has not been provided such that the carousel cannot be rotated.

28. A locking mechanism used to limit access to a consumable component in an imaging device, comprising:

a locking member that secures an access door that leads to the consumable component, wherein the locking member is further configured to only disengage to release the access door when valid authorization information is provided.

29. A system for limiting access to imaging device consumable components, comprising:

means for selectively preventing access specifically to a consumable component; and means for controlling the means for selectively preventing access, the means for controlling being responsive to authorization information provided by a user who wishes to access the consumable component.

30. The system of claim 29, wherein the means for selectively preventing access comprises a locking mechanism and wherein the means for controlling comprises a consumable security manager.

* * * * *